US011820472B1

(12) United States Patent
Capezzuto

(10) Patent No.: US 11,820,472 B1
(45) Date of Patent: Nov. 21, 2023

(54) ILLUMINATED LIFE JACKET

(71) Applicant: John Capezzuto, Littleton, CO (US)

(72) Inventor: John Capezzuto, Littleton, CO (US)

(73) Assignee: John O. Capezzuto, Littleton, CO (US)

( * ) Notice: Subject to any disclaimer, the term of this patent is extended or adjusted under 35 U.S.C. 154(b) by 0 days.

(21) Appl. No.: 17/194,027

(22) Filed: Mar. 5, 2021

Related U.S. Application Data

(60) Provisional application No. 62/985,519, filed on Mar. 5, 2020.

(51) Int. Cl.
*B63C 9/20* (2006.01)
*B63C 9/11* (2006.01)

(52) U.S. Cl.
CPC . *B63C 9/20* (2013.01); *B63C 9/11* (2013.01)

(58) Field of Classification Search
CPC ..... B63C 9/20; B63C 9/11
See application file for complete search history.

(56) References Cited

U.S. PATENT DOCUMENTS 2,070,818 A 2/1937 Winckler
3,638,258 A 2/1972 Black
5,237,491 A * 8/1993 McCarter ..... B63C 9/20 362/186
5,326,297 A 6/1994 Loughlin
5,370,566 A 12/1994 Mitchell, Jr. et al.
5,423,282 A 6/1995 Krull et al.
5,690,413 A 11/1997 Coughlin
6,558,082 B1 5/2003 Courtney et al.
7,056,179 B2 * 6/2006 Courtney ..... B63C 9/1255 441/90
7,195,369 B2 3/2007 Shaw
7,530,873 B1 * 5/2009 Chang ..... B63C 9/20 441/89
9,376,183 B2 6/2016 Cannici et al.
9,381,982 B1 * 7/2016 Sumpter ..... G01S 19/17
9,637,209 B1 5/2017 Brown
9,981,725 B1 * 5/2018 Brown ..... B63C 9/20
10,259,547 B1 * 4/2019 Kiel ..... B63C 9/20
10,286,987 B2 * 5/2019 Duff ..... B63C 9/20
2004/0248483 A1 * 12/2004 Bolta ..... B63C 9/20 441/80
2007/0153507 A1 7/2007 Tarter et al.
2007/0287342 A1 * 12/2007 Russell ..... B63C 9/11 441/89
2008/0205049 A1 8/2008 Brain
2008/0214074 A1 9/2008 Fan
2011/0097952 A1 4/2011 Pirie
2012/0033411 A1 2/2012 Heo
2012/0300435 A1 11/2012 Hill
(Continued)

*Primary Examiner* — S. Joseph Morano
*Assistant Examiner* — Jovon E Hayes

(57) ABSTRACT

A life jacket includes a main body defining a neck opening, a left arm opening and a right arm opening. The life jacket further includes at least one strip of reflective material; at least one lighting element electrically coupled to a power source; and at least two illuminating regions arranged on the main body. For each of the at least two illuminating regions, the at least one strip of reflective material forms a perimeter thereof and surrounds at least one of the at least one lighting element. The at least one of the at least one lighting element is configured to emit light rays to illuminate the respective area surrounded by the at least one strip of reflective material.

20 Claims, 10 Drawing Sheets

(56) References Cited

U.S. PATENT DOCUMENTS

| | | | | |
|---|---|---|---|---|
| 2016/0309802 | A1* | 10/2016 | Standard | A41D 1/002 |
| 2018/0281909 | A1 | 10/2018 | Distelrath | |
| 2019/0185120 | A1 | 6/2019 | Clark | |
| 2019/0210702 | A1* | 7/2019 | Devereux | B63C 9/115 |

* cited by examiner

ILLUMINATED LIFE JACKET

CROSS-REFERENCE TO RELATED APPLICATIONS

This application claims the benefit of U.S. Provisional Patent Application No. 62/985,519, filed on Mar. 5, 2020, which is incorporated herein by reference in its entirety.

FIELD OF THE INVENTION

The present invention relates generally to personal flotation devices, and more particularly, to an illuminated life jacket.

BACKGROUND OF THE INVENTION

Personal flotation devices, such as life jackets, are known and used in the art to facilitate a person floating in the ocean, a lake, a river, a pool, or other body of water, especially in the event of an emergency. However, even if such devices are successfully used to maintain a person at water surface, visibility can be an important factor and can make a difference between life and death. For example, during the evening, or with limited daylight, rescue personnel or passers-by may have difficulty identifying people floating in the water. This may prolong, or even prevent rescue personnel from locating such persons in the water. Particularly in cold water scenarios, time may be a critical factor in preventing death since the risk of freezing increases the longer a person is in the water waiting for rescue. While finding people stranded in a large body of water can be difficult even during the day, the evening presents an even greater risk that persons floating in the water may not be found in time. To increase visibility of people floating in water, some life jackets may include reflective features; however, this may still not provide sufficient illumination, especially during the evening.

Accordingly, there is need for a solution to at least one of the aforementioned problems. For instance, there is an established need for a personal flotation device that enables a person stranded in a body of water to be more easily discovered by others, such as, by a search and rescue team.

SUMMARY OF THE INVENTION

The present invention is directed to a life jacket including a main or vest body defining a neck opening, a left arm opening and a right arm opening. The main body may further include at least one strip of reflective material; at least one lighting element electrically coupled to a power source; and one or more illuminating regions arranged on the main body. For each of the one or more illuminating regions, the at least one strip of reflective material may form a perimeter thereof and may surround at least one of the at least one lighting element. The at least one of the at least one lighting element is configured to emit light rays to illuminate the respective area surrounded by the at least one strip of reflective material. In some aspects, the at least one of the at least one lighting element is configured to emit light rays to uniformly illuminate the respective area surrounded by the at least one strip of reflective material.

In a first implementation of the invention, a life jacket may include a buoyant, main body, the main body wearable on a subject's torso and comprising a neck opening, a left arm opening and a right arm opening. The main body may further comprise, or carry, a power source and at least one lighting element electrically coupled to the power source. One or more illuminating regions may be formed on the main body, the one or more illuminating regions configured to allow the passing therethrough of light emitted by the at least one lighting element such that said light is visible from outside the main body. Each illuminating region of the one or more illuminating regions may be at least partially bordered by a reflective material.

In a second aspect, the at least one lighting element may include a plurality of lighting elements. Each illuminating region of the one or more illuminating regions may include one or more respective lighting elements of the plurality of lighting elements arranged within the perimeter of said each illuminating region.

In another aspect, the main body may further include a switch electrically coupled to the power source and the at least one lighting element for selectively powering the at least one lighting element.

In another aspect, the switch may be manually operable from outside the main body.

In another aspect, the left and right arm openings may be bordered by a left arm opening reflective material strip and a right arm opening material strip, respectively.

In yet another aspect, the neck opening may be bordered by a neck opening reflective material strip.

In another aspect, the one or more illuminating regions may include a front left chest illuminating region and a front right chest illuminating region arranged at left and right chest sections of a front side of the main body.

In another aspect, the front left chest illuminating region may be bordered by a left arm opening reflective material strip which borders the left arm opening, by a neck opening reflective material strip which borders the neck opening, by a front left, intermediate reflective material strip that extends between the left arm opening reflective material strip and the neck opening reflective material strip at a first height on a front side of the main body, and by a front left, lower torso reflective material strip that extends between the left arm opening reflective material strip and the neck opening reflective material strip at a second height on the front side of the main body, the second height lower than the first height.

In another aspect, the front right chest illuminating region may be bordered by a right arm opening reflective material strip which borders the right arm opening, by a neck opening reflective material strip which borders the neck opening, by a front right, intermediate reflective material strip that extends between the right arm opening reflective material strip and the neck opening reflective material strip at a first height on a front side of the main body, and by a front right, lower torso reflective material strip that extends between the right arm opening reflective material strip and the neck opening reflective material strip at a second height on the front side of the main body, the second height lower than the first height.

In yet another aspect, the one or more illuminating regions may include a rear left chest illuminating region and a rear right chest illuminating region arranged at left and right chest sections of a rear side of the main body.

In another aspect, the rear left chest illuminating region may be bordered by a left arm opening reflective material strip which borders the left arm opening, by a neck opening reflective material strip which borders the neck opening, by a rear left, intermediate reflective material strip that extends between the left arm opening reflective material strip and the neck opening reflective material strip at a first height on a rear side of the main body, and by a rear left, lower torso reflective material strip that extends between the left arm opening reflective material strip and the neck opening reflective material strip at a second height on the rear side of the main body, the second height lower than the first height.

In another aspect, the rear right chest illuminating region may be bordered by a right arm opening reflective material strip which borders the right arm opening, by a neck opening reflective material strip which borders the neck opening, by a rear right, intermediate reflective material strip that extends between the right arm opening reflective material strip and the neck opening reflective material strip at a first height on a rear side of the main body, and by a rear right, lower torso reflective material strip that extends between the right arm opening reflective material strip and the neck opening reflective material strip at a second height on the rear side of the main body, the second height lower than the first height.

In another aspect, the one or more illuminating regions may include a left shoulder illuminating region and a right shoulder illuminating region arranged at left and right shoulder sections of the main body.

In yet another aspect, the left shoulder illuminating region may be bordered by a left arm opening reflective material strip which borders the left arm opening, by a neck opening reflective material strip which borders the neck opening, by a front left, intermediate reflective material strip that extends between the left arm opening reflective material strip and the neck opening reflective material strip on a front side of the main body, and by a rear left, intermediate reflective material strip that extends between the left arm opening reflective material strip and the neck opening reflective material strip on a rear side of the main body.

In another aspect, the right shoulder illuminating region may be bordered by a right arm opening reflective material strip which borders the right arm opening, by a neck opening reflective material strip which borders the neck opening, by a front right, intermediate reflective material strip that extends between the right arm opening reflective material strip and the neck opening reflective material strip on a front side of the main body, and by a rear right, intermediate reflective material strip that extends between the right arm opening reflective material strip and the neck opening reflective material strip on a rear side of the main body.

In another aspect, the one or more illuminating regions may include at least one illuminating region arranged between two waist-securing straps carried by the main body.

In another aspect, the one or more illuminating regions may include at least one illuminating region arranged between a waist-securing strap carried by the main body and a bottom edge of the main body.

In yet another aspect, the one or more illuminating regions may include a refractive layer configured to refract the light emitted by the at least one lighting element to substantially uniformly illuminate the one or more illuminating regions.

In another aspect, the light refractive layer may comprise a dual-layer cover including a first refractive inner layer and a second outer layer, the first refractive inner layer arranged to receive, on a surface thereof, light rays emitted from the at least one lighting element and to refract the received light rays toward the second outer layer to substantially uniformly disperse the light rays outward of the outer layer.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

The present invention is directed toward an illuminated life jacket that increases visibility of a person stranded in a body of water, and thus may enable the stranded person to be more easily discovered by a search and rescue team. Shown throughout the figures are several embodiments of the invention.

Figure 1:
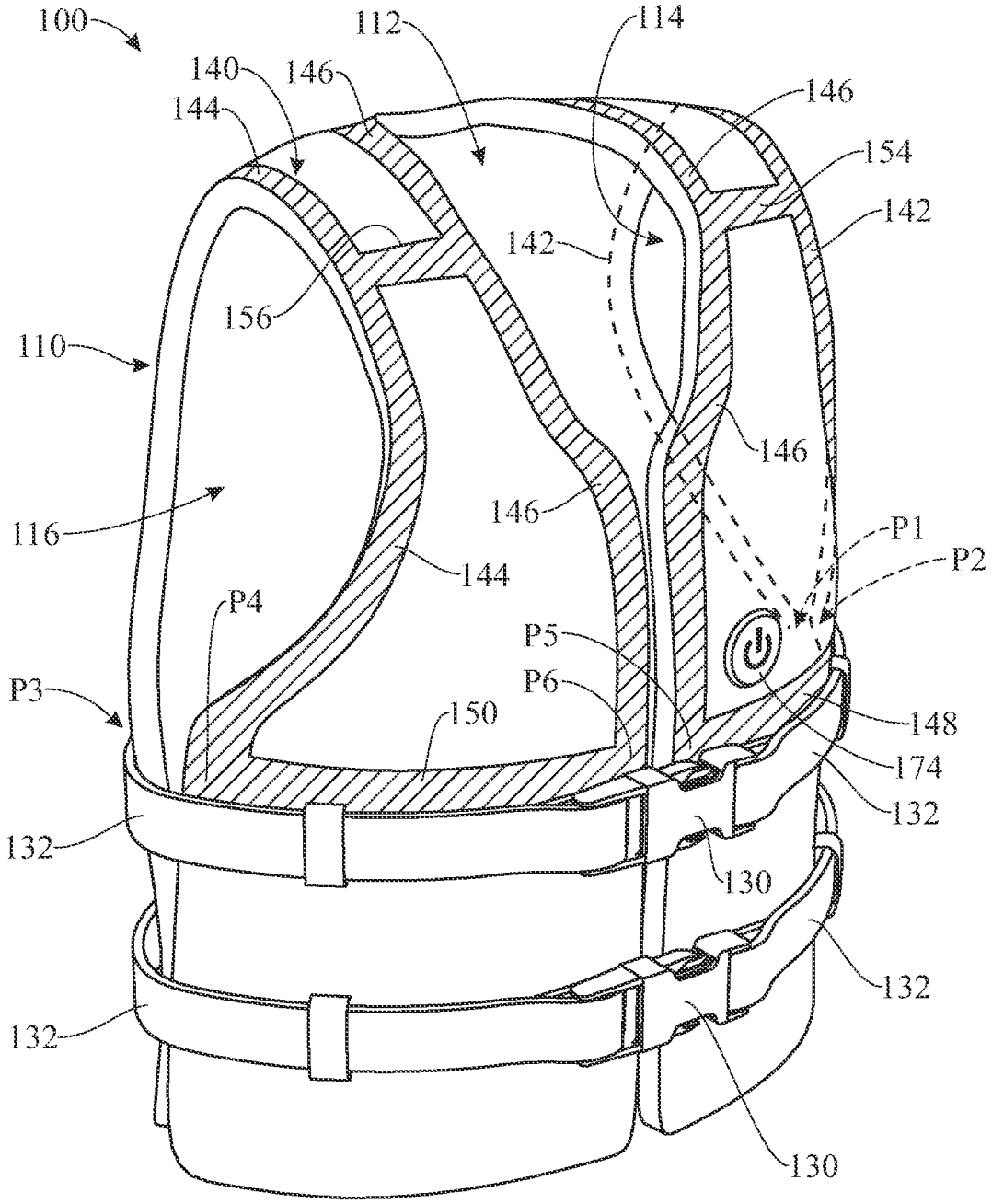
FIG. 1 presents a perspective, front view of a first embodiment of a life jacket according to the present invention.
Figure 2:
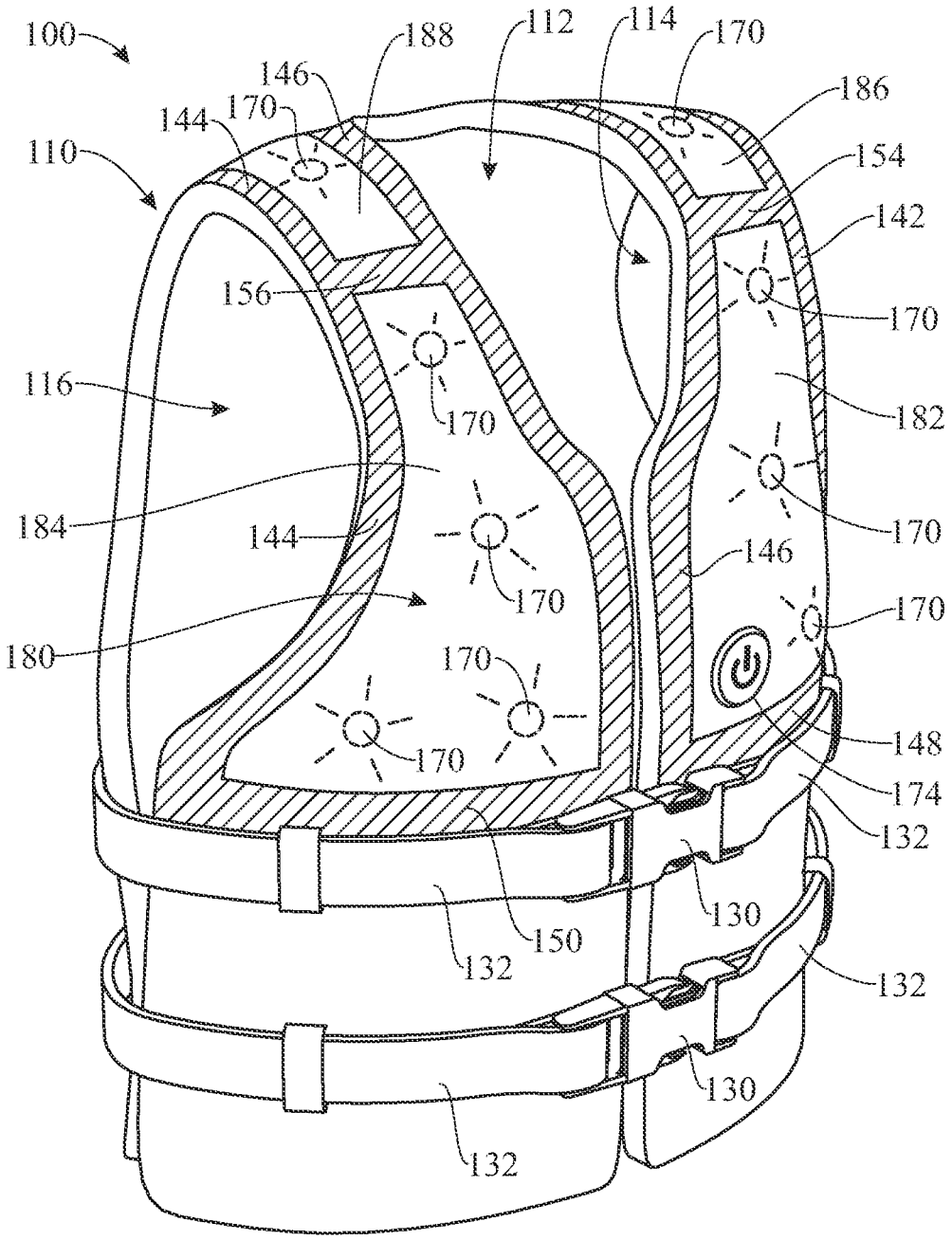
FIG. 2 presents a perspective, front view of the first embodiment of the life jacket illustrating an example arrangement of lighting elements according to the present invention.

The illustrations of FIGS. 1-5 show an illuminated life vest or jacket, hereinafter life jacket 100, in accordance with a first exemplary embodiment of the present invention. Referring initially to FIGS. 1 and 2, as shown, the life jacket 100 includes a main body or vest body 110, referred to hereinafter as vest body 110, one or more strips of reflective material 140 and at least one lighting element 170. The at least one lighting element 170 is preferably a plurality of lighting elements 170, as shown. The one or more lighting elements 170 are neither illuminated nor visible in FIG. 1 and are shown illuminated in FIG. 2.

With continued reference to FIG. 1, the vest body 110 may be configured as a buoyant body and may be sized and shaped to fit on an upper area of the body of the user as a vest having a buoyancy and/or providing a flotation capability for the wearer. In some embodiments, the vest body 110 may be made of a buoyant material (e.g., foam, neoprene, cork, balsa wood, etc.), may be inflatable, or may be both made of a buoyant material and inflatable. The vest body 110 may define a neck opening 112, a left arm opening 114 and a right arm opening 116, which may allow the life jacket 100 to fit over the user's head or onto the user's torso to rest on the user's shoulders and to permit the user's arms to pass through the arm openings 114, 116, like a typical shirt/vest garment. In some embodiments, for instance, the neck opening 112 is configured to extend around the user's neck and also along a front of the user's body, and may extend to the bottom of the vest body 110, as shown. Similarly, the left and arm openings 114 and 116 may extend around the user's arms, preferably at or near the shoulders, and may extend downward along the left and right sides of the vest body 110 such as to the bottom of the vest body 110, as shown. However, alternative embodiments are contemplated regarding the openings 112, 114 and 116 without departing from the scope of the present disclosure.

In different embodiments of the invention, the shape and/or size of the vest body 110 may vary. For instance, in some embodiments, the vest body 110 may be sized to fit an average adult male wearer. In other embodiments, the vest body 110 may be sized to fit a smaller individual, such as an average woman or a child. One or more sets of buckles 130 and preferably adjustable straps 132 may be provided on a waist area of the vest body 110 to fasten the life jacket 100 securely to the wearer. For instance, the present embodiment includes two sets of straps 132 and buckles 130, with each buckle 130 configured to securing opposite front ends of the straps 132 to each other. The straps 132 can optionally encircle a full perimeter of the vest body 110. However, alternative embodiments are contemplated. For example, two opposite side strap portions can extend from opposite left and right sides of the vest body 110, and attach at the front of the vest body 110. As shown, the one or more straps 132 can be located in an area of the vest body 110 corresponding to the lower torso and, optionally, the waist of the wearer.

As described heretofore, the vest body 110 may be considered to provide the flotation capability of the life jacket 100. Floatable life vests are generally known and therefore the floatable features of the present life jacket 100 will not be described in greater detail herein. In addition, the vest body 110 of the present disclosure provides a substrate or body on which the various illumination features of the life jacket 100 may be disposed and arranged on.

As mentioned heretofore, arranged on the vest body 110 may be one or more strips of reflective material 140. The one or more strips of reflective material 140 (hereinafter "strips of reflective material" or "reflective material") may be disposed on an exterior surface of the vest body 110 so as to be visible from outside the vest body 110. The reflective material 140 may be affixed to the exterior surface of the vest body 110 by an adhesive, stitching, heat welding or other fastening elements or procedures. The reflective material 140 may be made of any reflective material, such as, but not limited to, reflective tape, reflective sheet, a reflective fabric, etc. For example, the reflective material 140 may be made of micro glass beads with a reflective aluminum coating. In some embodiments, the reflective material 140 may be made of a fluorescent fabric. In yet other embodiments, the reflective material 140 may be made of other types of reflective technologies. The reflective material 140 may be of any color, such as white, yellow, orange, or other reflective colors. In an embodiment in which multiple strips of reflective material 140 are used, the strips may vary in color to provide a more visually distinctive appearance. The strips of reflective material 140 may preferably be water impermeable and ruggedized to be suitable for outdoor use and exposure to weather and water sports/activities.

In some embodiments, the strip of reflective material 140 may form a perimeter boundary of a closed shape (e.g., polygon or irregular shape) and may thereby define, along with the lighting element(s) 170, a distinct illuminating region, which will be discussed in more detail below.

Specifically, each of the neck opening 112, left arm opening 114 and right arm opening 116 may be bordered by the at least one strip of reflective material 140, as shown in FIGS. 1-5. More specifically, and with reference to FIGS. 1 and 3, which show front and rear views of the life jacket 100, the at least one strip of reflective material 140 may include a left arm opening reflective material strip 142 located at or near the left arm opening 114 and bordering the left arm opening 114. The left arm opening reflective material strip 142 extends, preferably continuously, from a position P1 on a rear side of the vest body 110 adjacent to the upper edge of the top strap 132 and facing the left arm opening 114, to a position P2 adjacent to the upper edge of the top strap 132 and facing the left arm opening 114 on a front side of the vest body 110. Similarly (e.g., symmetrically) to the left arm opening reflective material strip 142, a right arm opening reflective material strip 144 is located at or near the right arm opening 116 and bordering the right arm opening 116, in a preferably continuous manner, from a position P3 on the vest body 110 adjacent to the upper edge of the top strap 132 and facing the right arm opening 116 on a rear side of the vest body 110 to a position P4 adjacent to the upper edge of the top strap 132 and facing the right arm opening 116 on a front side of the vest body 110. A neck opening reflective material strip 146, in turn, is located at or near the neck opening 112 and borders the neck opening 112 in a preferably continuous manner from a position P5 on a front, left-hand side of the vest body 110 adjacent to the upper edge of the top strap 132 and facing the neck opening 112, to a position P6 on a front, right-hand side of the vest body 110 adjacent to the upper edge of the top strap 132 and facing the neck opening 112.

Figure 3:
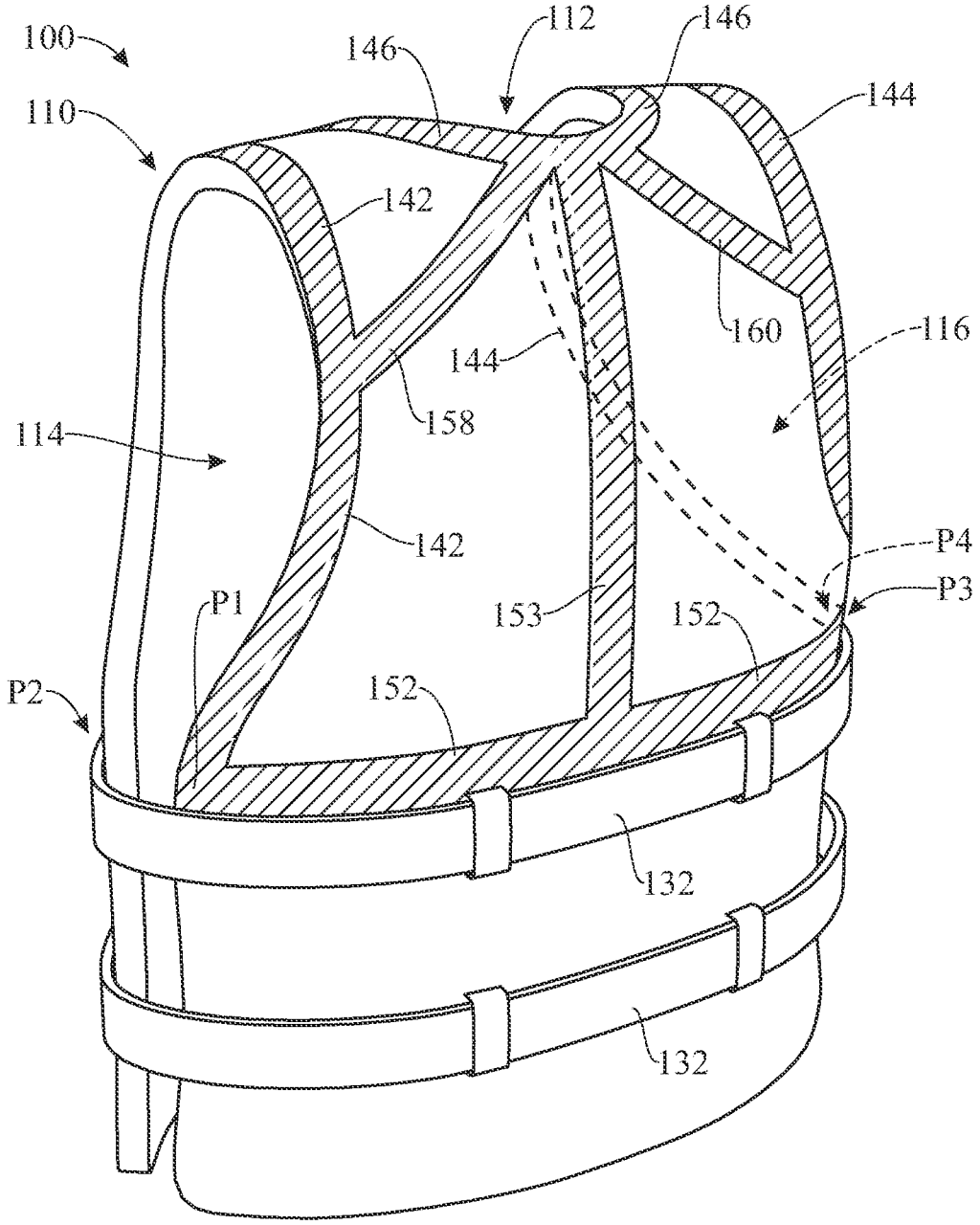
FIG. 3 presents a perspective, rear view of the first embodiment of the life jacket according to the present invention.

As further shown in FIG. 1, the at least one strip of reflective material 140 may include a front left, lower torso reflective material strip 148 and a front right, lower torso reflective material strip 150. The front left, lower torso reflective material strip 148 extends generally transversely and horizontally along, and adjacent to, an upper edge of the top strap 132, from the left arm opening reflective material strip 142 at position P2 to the neck opening reflective material strip 146 at position P5. In turn, the front right, lower torso reflective material strip 150 extends generally transversely and horizontally along, and adjacent to, an upper edge of the top strap 132, from the right arm opening reflective material strip 144 at position P4 to the neck opening reflective material strip 146 at position P6. As shown in FIG. 3, the at least one strip of reflective material 140 may include a rear, lower torso reflective material strip 152 extending generally transversely and horizontally along, and adjacent to, an upper edge of the top strap 132, from the left arm opening reflective material strip 142 at position P1 to the right arm opening reflective material strip 144 at position P3. The lower torso reflective material strips 148, 150, 152 jointly extend along practically the entire perimeter of the lower torso of the vest body 110, except for the sections of the perimeter occupied by the left and right arm openings 114 and 116, as shown. Furthermore, as best shown in FIG. 3, a rear, vertical reflective material strip 153 may extend from the neck opening reflective material strip 146 on a rear side of the vest body 110 to the rear, lower torso reflective material strip 152. For instance, the rear, vertical reflective material strip 153 may be centrally located on the rear side of the vest body 110 and may extend from a rear, central section of the neck opening reflective material strip 146 to a central section of the rear, lower torso reflective material strip 152, as shown.

As further shown in FIGS. 1 and 3, the at least one strip of reflective material 140 may include at least one reflective material strip extending across intermediate sections of the vest body 110 on the front side and/or the rear side of the vest body 110. For instance, as shown in FIG. 1, a front left, intermediate reflective material strip 154 may extend transversely from the left arm opening reflective material strip 142 to the neck opening reflective material strip 146, and a front right, intermediate reflective material strip 156 may extend transversely from the right arm opening reflective material strip 144 to the neck opening reflective material strip 146. The left and right arm opening reflective material strips 154 and 156 may be horizontally oriented or sloped, and/or may be arranged at the same or different height relative to one another. For example, in the present embodiment, the left and right arm opening reflective material strips 154 and 156 extend transversely and also horizontally along the vest body 110 and are arranged at a same height. In addition, the present embodiment further includes a rear left, intermediate reflective material strip 158 extending transversely from the left arm opening reflective material strip 142 to the neck opening reflective material strip 146, and a rear right, intermediate reflective material strip 160 extending transversely from the right arm opening reflective material strip 144 to the neck opening reflective material strip 146. The rear left and right, intermediate reflective material strips 158 and 160 may be arranged at a same or different height and may be sloped or horizontal. For instance, in the present embodiment, the rear left and right, intermediate reflective material strips 158 and 160 are arranged at a same height and are sloped.

As shown in FIG. 2 and mentioned heretofore, arranged on the vest body 110 may be one or more lighting element(s) 170, which may be any type of lighting element, such as, but not limited to, a light emitting diode (LED), incandescent lamp, neon lamp, etc. The number of lighting elements 170 arranged on the vest body 110 may be any number. Preferably, the lighting elements 170 are small and lightweight enough to be arranged on the vest body 110 without compromising buoyancy of the wearer, and yet also provide a high intensity and low power consumption illumination effect. In some embodiments, the lighting element 170 may be encapsulated by a water impermeable structure, or have another type of waterproof feature to prevent water damage. For example, in one embodiment, each lighting element 170 is encapsulated by a respective elastic or rubber bubble pack. The lighting elements 170 may be of any color, such as white or red. The lighting elements 170 of the life jacket 100 may all be of one color, or may be of different colors and may be configured to have present a diverse pattern of colors in some embodiments. In some embodiments, each illuminating region may have lighting elements 170 of a distinct color.

Figure 4:
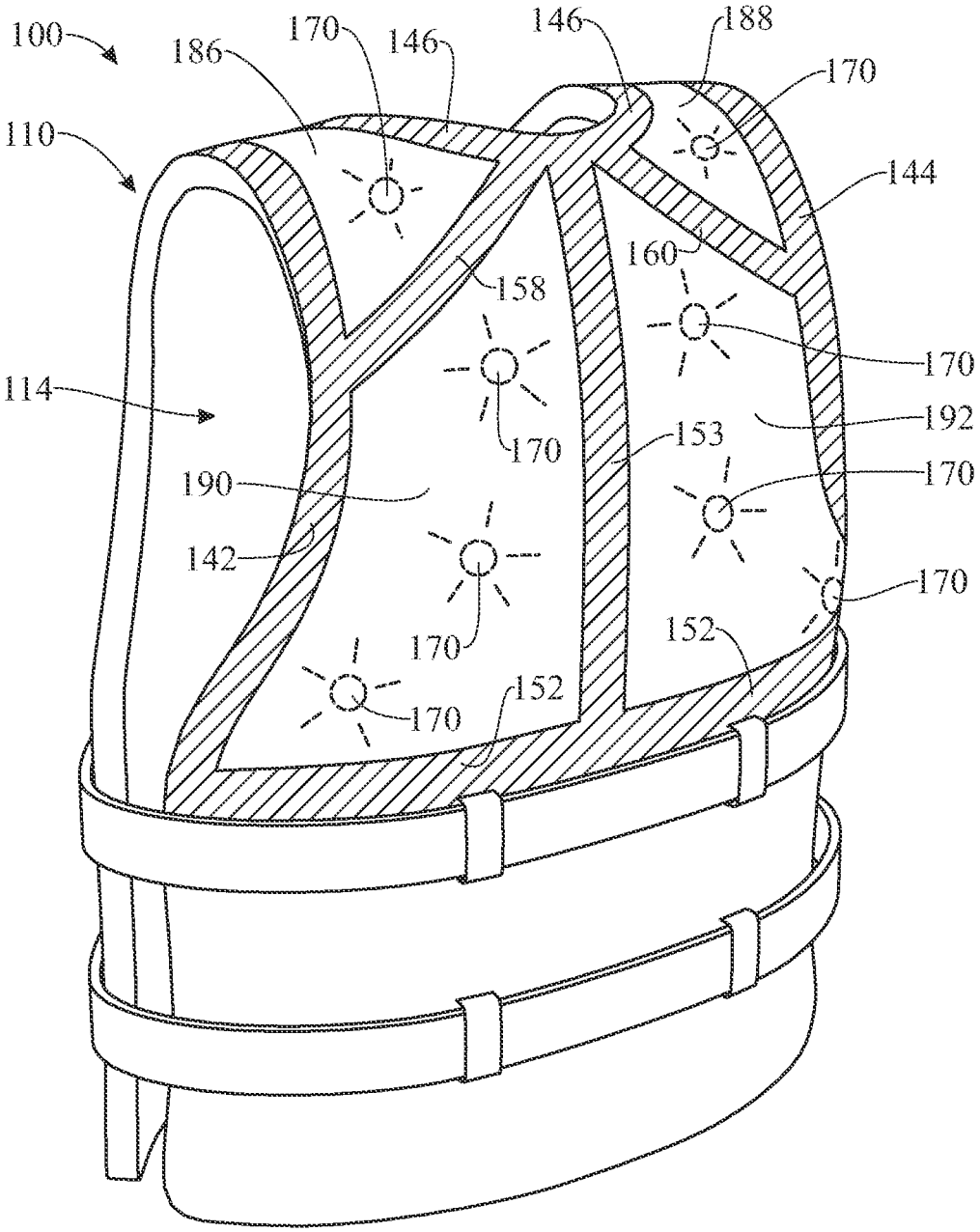
FIG. 4 presents a perspective, rear view of the first embodiment of the life jacket illustrating an example arrangement of lighting elements according to the present invention.
Figure 5:
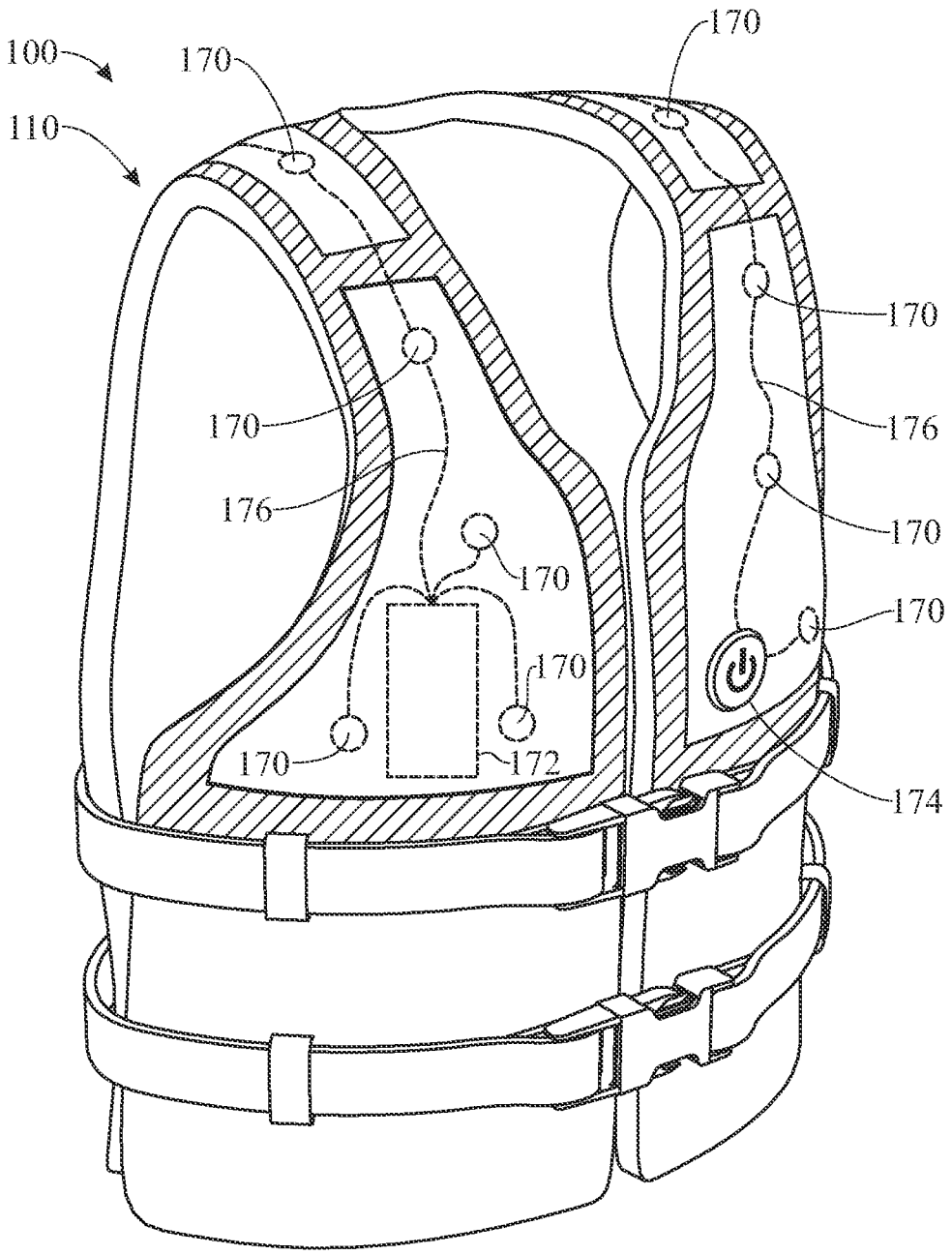
FIG. 5 presents a perspective, front view of the first embodiment of the life jacket illustrating an example arrangement of electrical components according to the present invention.

Attention is now directed to FIGS. 2, 4 and 5, which show the lighting elements 170. As shown in FIG. 5, the lighting elements 170 may be electrically and operatively coupled (e.g., via electrical wiring 176) to a power source 172 and a switch 174. The power source 172 may include one or more batteries. In some embodiments, the battery or batteries may be rechargeable. In such embodiments, the life jacket 100 may be configured with a recharging port (e.g., Universal Serial Bus (USB) port) configured to provide electrical power transmission from an external power source to the battery or batteries during recharging. The power source 172, switch 174, recharging port, electrical wiring 176, and lighting elements 170 may preferably be encapsulated in a waterproof or water impermeable structure to prevent water damage to the electrical components as well as to the wearer.

The switch 174 may be configured to turn the lighting elements 170 on and off in response to a user input (e.g., pressing a button on the switch). For example, in some embodiments, the switch 174 may activate all the lighting elements 170 when the button is pressed once and the lighting elements 170 may remain on until the button is pressed again. Other types of switch operations and lighting patterns may be configured by circuitry connected to the switch 174; in one non-limiting example, double pressing of the button may cause the lighting elements to flash, rather than be stationary. Such lighting patterns may provide yet another point of visual attraction that may increase the changes of the wearer being seen by a potential rescuer.

Referring now primarily to FIGS. 2 and 4, which depict the front and rear of the life jacket 100, one or more illuminating regions 180 are provided by the life jacket 100. For each illuminating region 180, there is a specific strip of reflective material 140 that forms the perimeter of the illuminating region 180 and that specific strip of reflective material 140 further surrounds the lighting elements 170 that illuminate the respective illuminating region 180. Stated another way, the lighting elements 170 for each illuminating region 180 are arranged to emit light rays to uniformly illuminate the area surrounded by the respective strip of reflective material 140. The vest body 110 may be translucent to allow the illuminating regions 180 of the vest body 110 to become illuminated by the internal lighting elements 170.

In some embodiments, the strip of reflective material 140 may form a boundary of a closed shape, such as an irregular shape as shown in FIGS. 2 and 4. In some embodiments, the strip of reflective material 140, while being reflective, is also opaque, thus the light rays from the lighting elements 170 may be blocked where the strips of reflective material 140 are located, which creates a distinctly shaped illuminated area, for each of the illuminating regions 180. Stated another way, the illuminating regions 180 may each constitute a distinctly defined lighted area that is preferably completely surrounded or enclosed by a specific strip of reflective material 140. This unique lighting feature may be more visually discernable/attractive to a potential rescuer. The illuminating regions 180 may be arranged on the vest body 110 to remain visible above water when the user is wearing the life jacket 100 and floating in water. For example, in some embodiments, the illuminating regions 180 may be arranged on an upper portion of the vest body 110, as shown for instance in the present embodiment.

While the life jacket 100 may include any number of illuminating regions 180, in some embodiments, at least two illuminating regions 180 are preferably included to increase distinctiveness of the lift jacket 100 and distinguish the lift jacket 100 from other possibly illuminated elements found during an emergency situation. In some embodiments, there may be six distinct illuminating regions 180 in the life jacket 100. The six distinct illuminating regions 180 may include, as shown for instance in the present embodiment: a left shoulder illuminating region 186 and a right shoulder illuminating region 188 arranged in a left shoulder section and a right shoulder section of the vest body 110, respectively, as shown in FIGS. 2 and 4; a front left chest illuminating region 182 and a front right chest illuminating region 184 arranged at left and right chest or upper sections of the front side of the vest body 110, respectively, as shown in FIG. 2; and a rear left chest illuminating region 190 and a rear right chest illuminating region 192 arranged at left and right chest or upper sections on the rear side of the vest body 110, as shown in FIG. 4. Other arrangements, shapes, and numbers of the distinct illuminating regions 180 in the life jacket 100 are contemplated in yet other embodiments. For instance, the life jacket 100 may include any subset of the six distinct illuminating regions 180 described heretofore.

Figure 6:
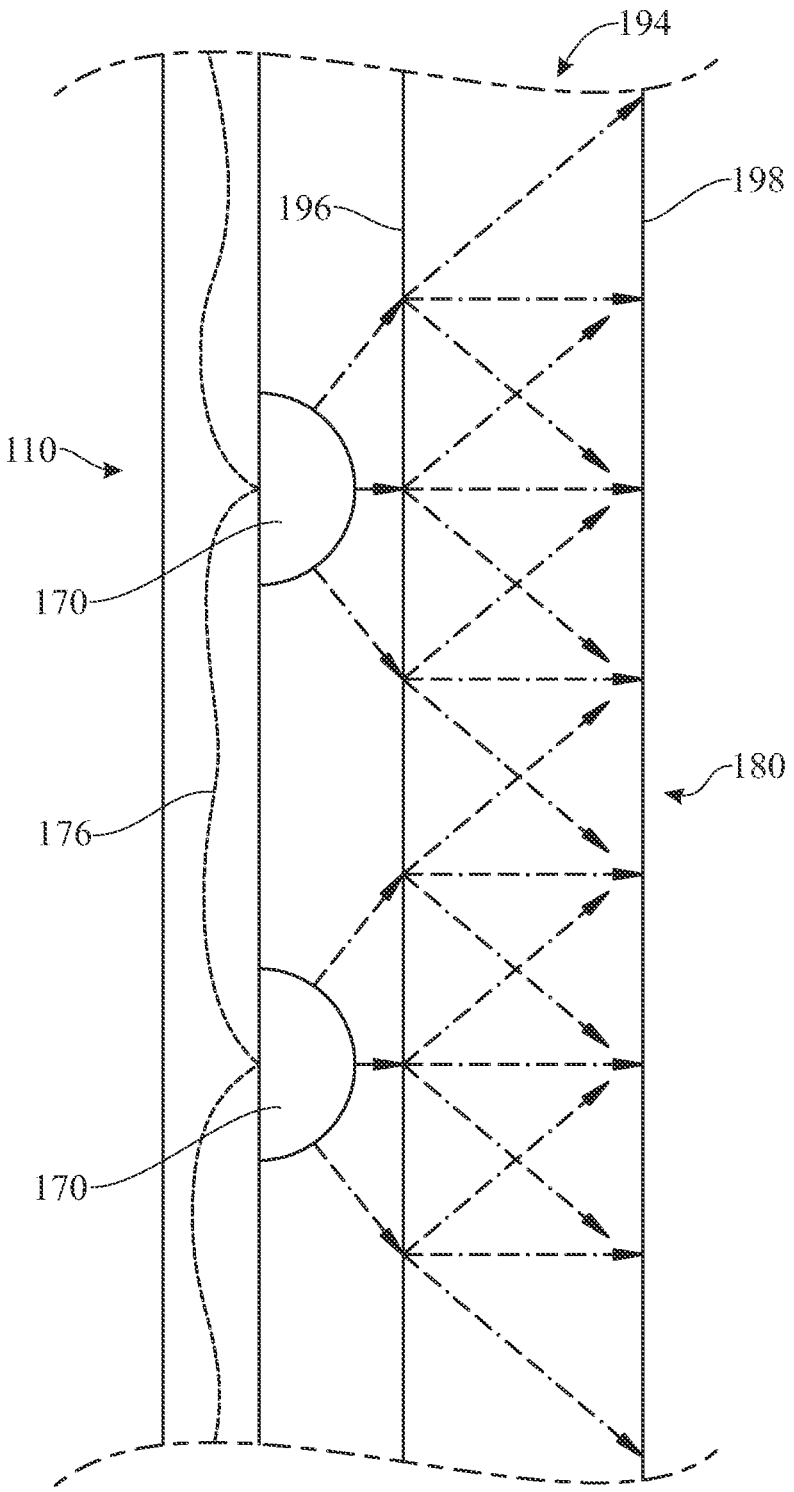
FIG. 6 presents a cross-sectional side elevation view of a portion of the first embodiment of the life jacket illustrating an example arrangement of a refractive dual-layer cover according to the present invention.

Referring now primarily to FIG. 6, a cross-sectional side elevational view of a portion of the life jacket 100 is shown illustrating an example arrangement of a light refractive vest cover (hereinafter light refractive cover 194), which may, in conjunction with the lighting elements 170, provide for a more uniform illumination (e.g., glow) in the illuminating regions 180. The light refractive cover 194 may be considered a cover for the vest body 110, which has light refractive properties. The light refractive cover 194 may be disposed over the lighting elements 170. In some embodiments, the light refractive cover 194 may be an outer layer of the vest body 110; alternatively, the light refractive cover 194 may be at least partially covered by one or more further outer layers which preferably allow illumination from the lighting elements 170 to pass through. The light rays emitted by the lighting elements 170 may be refracted by the light refractive cover 194 to project more uniformly across the light refractive cover 194, as shown in FIG. 6, and therefore more uniformly across the corresponding illuminating region 180. The light refractive cover 194 may be made of any material (or fabric with a coating) that has optical properties that allows light to pass through, while refracting the light rays to project substantially uniformly across the cover 194 and toward the outside of the cover 194. In some embodiments, the refractive cover 194 may be made of a luminescent material, a chemiluscent material, light phosphorus, etc.

In some embodiments, the light refractive cover 194 may be formed as a dual-layer cover including a first refractive inner layer 196 and a second outer layer 198. The first refractive inner layer 196 may be arranged to receive, on a surface thereof, light rays emitted from the at least one lighting element 170 and to refract the received light rays toward the second outer layer 198 to substantially uniformly disperse the light rays outward of the outer layer 198. In some embodiments, the second outer layer 198 may also be made of a refractive material. The refractive material of any one or both of the inner and outer layers 196, 198 may be a luminescent material, a chemiluscent material, and/or may include light phosphorus, etc.

Figure 7:
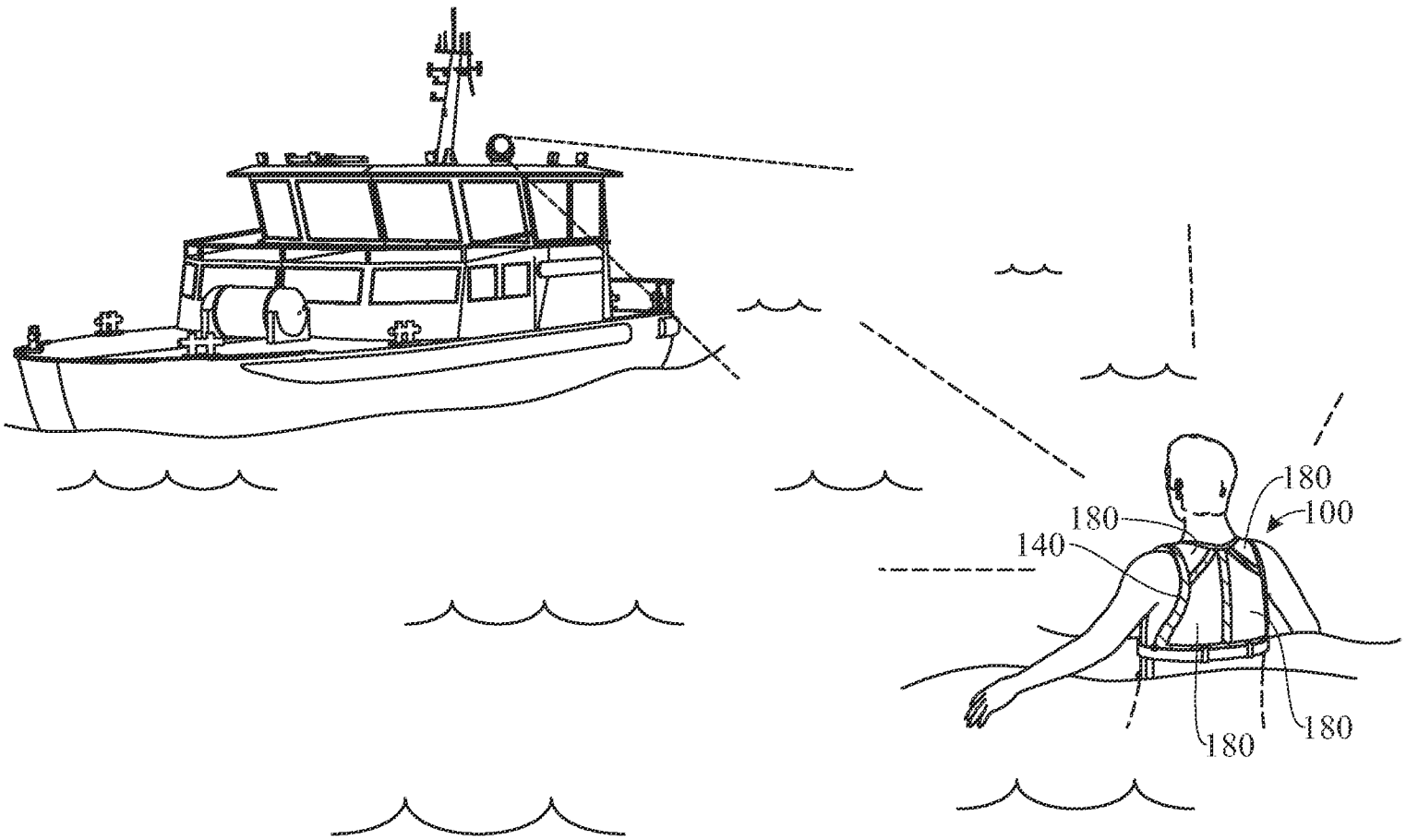
FIG. 7 illustrates a first example use of the first embodiment of the life jacket according to the present invention.

Referring now primarily to FIG. 7, a first example use of the life jacket 100 is shown worn on a user floating in water. As show, an upper portion of the life jacket 100 with the illuminating regions 180 is above the water as the user floats. Thus, even in the evening or during weather conditions such as fog where visibility is very limited, the illuminating regions 180 may allow rescuers to locate the user more quickly than other types of life jackets without such illuminating features.

Figure 8:
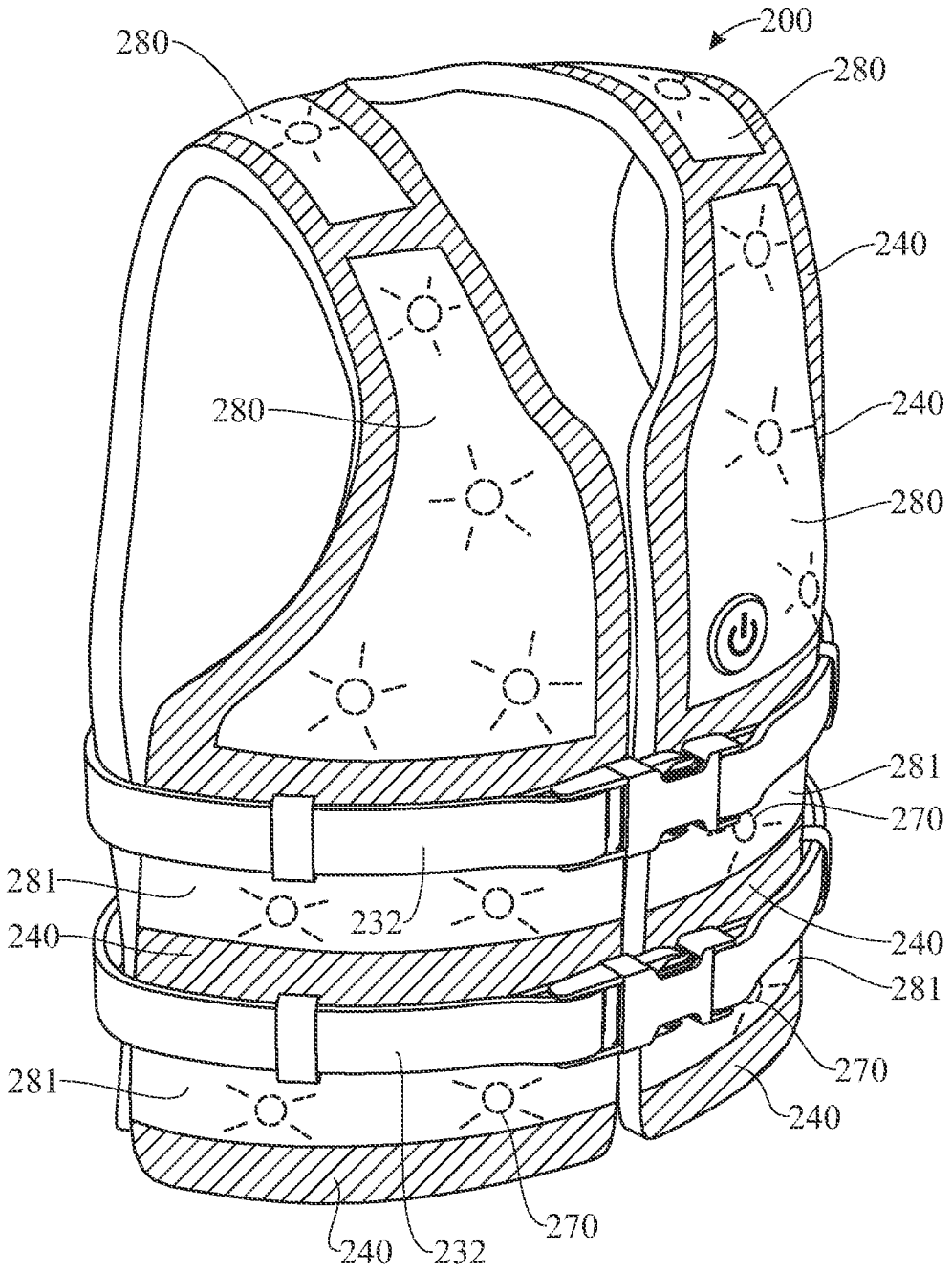
FIG. 8 presents a perspective, front view of a second embodiment of a life jacket including additional lower illuminating regions according to the present invention.
Figure 9:
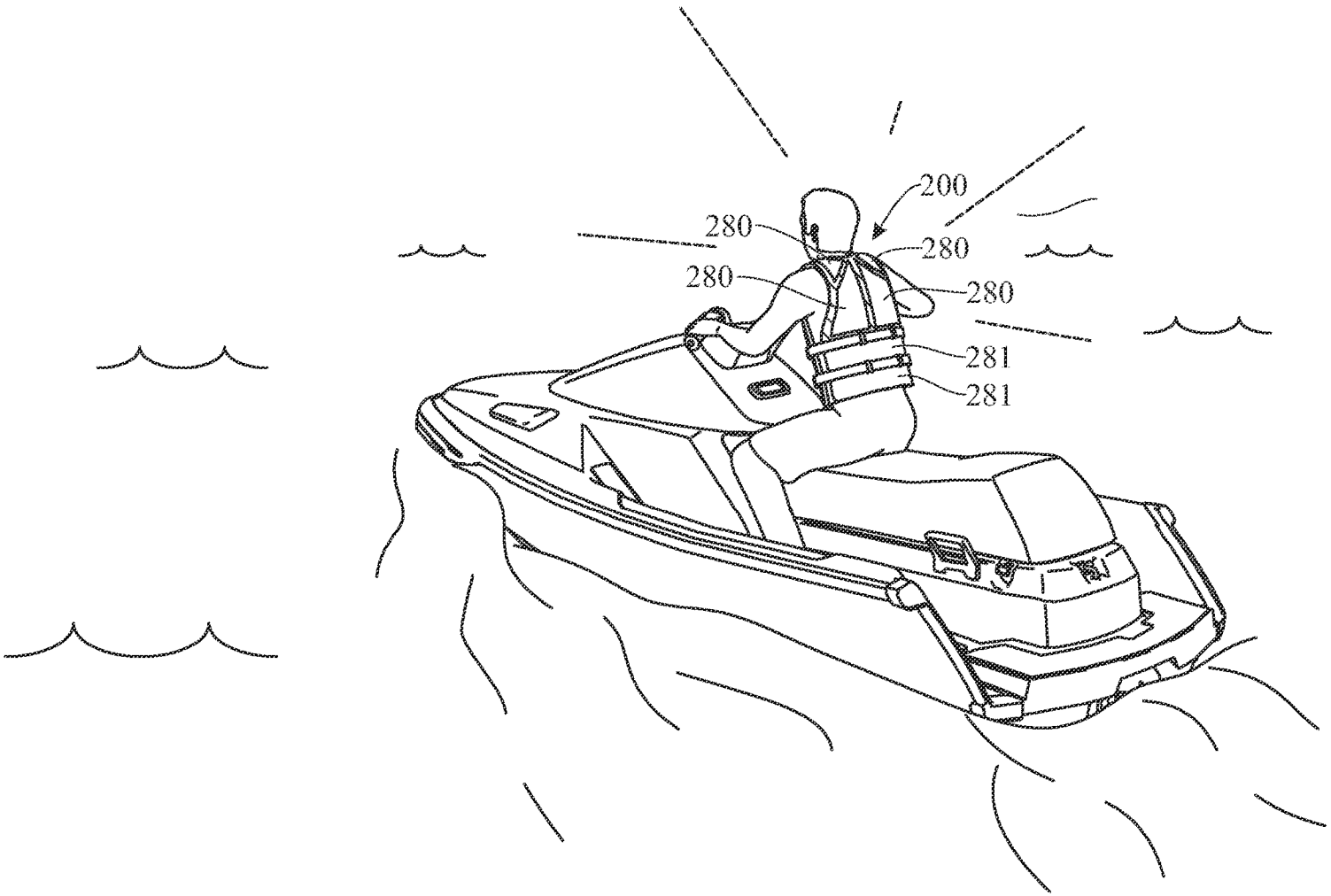
FIG. 9 illustrates a second example use of the life jacket according to the present invention.
Figure 10:
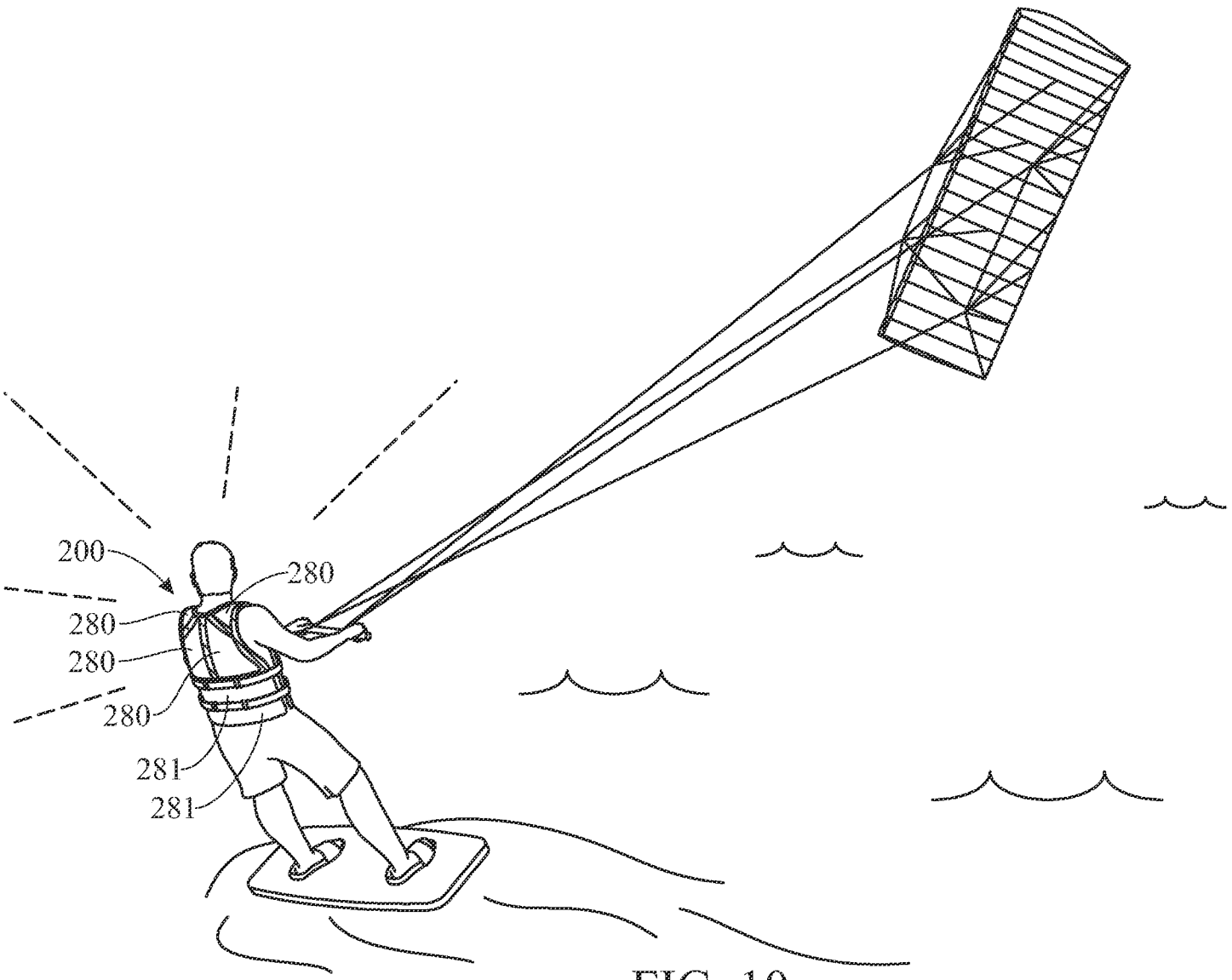
FIG. 10 illustrates yet a third example use of the life jacket according to the present invention.

Referring now to FIG. 8, a second embodiment of the life jacket, hereinafter life jacket 200, is illustrated. The life jacket 200 is similar to the first embodiment depicted in FIGS. 1-5, but is configured to include not only illuminating regions 280 similar to the illuminating regions 180 described with reference to the first embodiment, but also lower illuminating regions 281 arranged in a lower section of the life jacket 200 corresponding to the lower torso and, optionally, the waist area. In the present embodiment, the lower illuminating regions 281 are located between the top and bottom straps 232 and also below the bottom strap 232. As shown, the lower illuminating regions 281 may include illuminating regions 281 arranged between the straps 232, and/or illuminating regions 281 arranged in a portion of the vest body 110 which extends below the bottom strap 232. Except for placement and shape, these lower illuminating regions 281 may be the same or similar to the illuminating regions 180 described above for the first embodiment life jacket 100. For example, these lower illuminating regions 281 may be illuminated by one or more respective lighting elements 270 arranged within each lower illuminating region 281, as shown. In addition, the lower illuminating regions 281 may be at least partially surrounded by reflective material strips 240, as further shown. Such lower illuminating regions 281 may be particularly useful for above-water use, such as, for example, on a jet ski (see FIG. 9) and for kitesurfing (see FIG. 10). With a larger area of illuminating regions (illuminating regions 280 and lower illuminating regions 281) in the life jacket 200, even more visibility may be provided when the user is wearing the life jacket 200 outside of the water. Increased visibility of the wearer to others may be useful above-water to, for example, avoid collision with others, such as nearby boats or other water sports participants.

As shown throughout the figures, the present invention is directed toward an illuminated life jacket that may enable a person stranded in a body of water to be more easily discovered by a search and rescue team.

Alternative embodiments are contemplated in which, instead of a vest, the inventive illumination features disclosed herein may be implemented as another type of personal flotation garment, such as, for example, a jacket or shirt having long or short sleeves (rather than no sleeves, as with the vest embodiment). For a shirt embodiment, instead of a vest body, the life jacket may include a shirt/jacket body having a flotation capability, yet the illumination features may be the same or similarly arranged and configured thereon as described herein above and throughout.

Since many modifications, variations, and changes in detail can be made to the described preferred embodiments of the invention, it is intended that all matters in the foregoing description and shown in the accompanying drawings be interpreted as illustrative and not in a limiting sense.

Thus, the scope of the invention should be determined by the appended claims and their legal equivalents.

What is claimed is:

1. A life jacket comprising:

a buoyant, main body, the main body wearable on a subject's torso and comprising a neck opening, a left arm opening and a right arm opening, the main body further comprising:

a power source; wherein said power source is a waterproof 12 Volt rechargeable battery pack enclosed in silicone, coupled to a waterproof power switch with/but not limited to one or more modes of on, flash, strobe, and off, at least one lighting element; wherein said lighting element is a waterproof LED light enclosed in a silicone tube, electrically coupled to the power source, and one or more illuminating regions formed on the main body, the one or more illuminating regions configured to allow the passing therethrough of light emitted by the at least one lighting element such that said light is visible from outside the main body; wherein each illuminating region of the one or more illuminating regions is at least partially bordered by a reflective material; wherein said reflective material is micro glass beads with a reflective aluminum coating.

2. The life jacket of claim 1, wherein the at least one lighting element comprises a plurality of lighting elements, and further wherein each illuminating region of the one or more illuminating regions comprises one or more respective lighting elements of the plurality of lighting elements arranged within the perimeter of said each illuminating region.

3. The life jacket of claim 1, the main body further comprising a switch electrically coupled to the power source and the at least one lighting element for selectively powering the at least one lighting element.

4. The life jacket of claim 3, wherein the switch is manually operable from outside the main body.

5. The life jacket of claim 1, wherein the left and right arm openings are bordered by a left arm opening reflective material strip and a right arm opening material strip, respectively.

6. The life jacket of claim 1, wherein the neck opening is bordered by a neck opening reflective material strip.

7. The life jacket of claim 1, wherein the one or more illuminating regions comprise a front left chest illuminating region and a front right chest illuminating region arranged at left and right chest sections of a front side of the main body.

8. The life jacket of claim 7, wherein the front left chest illuminating region is bordered by a left arm opening reflective material strip which borders the left arm opening, by a neck opening reflective material strip which borders the neck opening, by a front left, intermediate reflective material strip that extends between the left arm opening reflective material strip and the neck opening reflective material strip at a first height on a front side of the main body, and by a front left, lower torso reflective material strip that extends between the left arm opening reflective material strip and the neck opening reflective material strip at a second height on the front side of the main body, the second height lower than the first height.

9. The life jacket of claim 7, wherein the front right chest illuminating region is bordered by a right arm opening reflective material strip which borders the right arm opening, by a neck opening reflective material strip which borders the neck opening, by a front right, intermediate reflective material strip that extends between the right arm opening reflective material strip and the neck opening reflective material strip at a first height on a front side of the main body, and by a front right, lower torso reflective material strip that extends between the right arm opening reflective material strip and the neck opening reflective material strip at a second height on the front side of the main body, the second height lower than the first height.

10. The life jacket of claim 1, wherein the one or more illuminating regions comprise a rear left chest illuminating region and a rear right chest illuminating region arranged at left and right chest sections of a rear side of the main body.

11. The life jacket of claim 10, wherein the rear left chest illuminating region is bordered by a left arm opening reflective material strip which borders the left arm opening, by a neck opening reflective material strip which borders the neck opening, by a rear left, intermediate reflective material strip that extends between the left arm opening reflective material strip and the neck opening reflective material strip at a first height on a rear side of the main body, and by a rear left, lower torso reflective material strip that extends between the left arm opening reflective material strip and the neck opening reflective material strip at a second height on the rear side of the main body, the second height lower than the first height.

12. The life jacket of claim 10, wherein the rear right chest illuminating region is bordered by a right arm opening reflective material strip which borders the right arm opening, by a neck opening reflective material strip which borders the neck opening, by a rear right, intermediate reflective material strip that extends between the right arm opening reflective material strip and the neck opening reflective material strip at a first height on a rear side of the main body, and by a rear right, lower torso reflective material strip that extends between the right arm opening reflective material strip and the neck opening reflective material strip at a second height on the rear side of the main body, the second height lower than the first height.

13. The life jacket of claim 1, wherein the one or more illuminating regions comprise a left shoulder illuminating region and a right shoulder illuminating region arranged at left and right shoulder sections of the main body.

14. The life jacket of claim 13, wherein the left shoulder illuminating region is bordered by a left arm opening reflective material strip which borders the left arm opening, by a neck opening reflective material strip which borders the neck opening, by a front left, intermediate reflective material strip that extends between the left arm opening reflective material strip and the neck opening reflective material strip on a front side of the main body, and by a rear left, intermediate reflective material strip that extends between the left arm opening reflective material strip and the neck opening reflective material strip on a rear side of the main body.

15. The life jacket of claim 13, wherein the right shoulder illuminating region is bordered by a right arm opening reflective material strip which borders the right arm opening, by a neck opening reflective material strip which borders the neck opening, by a front right, intermediate reflective material strip that extends between the right arm opening reflective material strip and the neck opening reflective material strip on a front side of the main body, and by a rear right, intermediate reflective material strip that extends between the right arm opening reflective material strip and the neck opening reflective material strip on a rear side of the main body.

16. The life jacket of claim 1, wherein the one or more illuminating regions comprise at least one illuminating region arranged between two waist-securing straps carried by the main body.

17. The life jacket of claim 1, wherein the one or more illuminating regions comprise at least one illuminating region arranged between a waist-securing strap carried by the main body and a bottom edge of the main body.

18. The life jacket of claim 1, wherein the one or more illuminating regions comprise a refractive layer configured to refract the light emitted by the at least one lighting element to substantially uniformly illuminate the one or more illuminating regions.

19. A life jacket comprising:

a buoyant, main body, the main body wearable on a subject's torso and comprising a neck opening, a left arm opening and a right arm opening, the main body further comprising:

a power source; wherein said power source is a waterproof 12 Volt rechargeable battery pack enclosed in silicone coupled to a waterproof power switch with/but not limited to one or more modes of on, flash, strobe, and off, a plurality of lighting element; wherein said lighting element is a waterproof LED light enclosed in a silicone tube, electrically coupled to the power source, and one or more illuminating regions formed on the main body, the one or more illuminating regions configured to allow the passing therethrough of light emitted by the at least one lighting element such that said light is visible from outside the main body; wherein each illuminating region of the one or more illuminating regions is at least partially bordered by a reflective material; wherein said reflective material is micro glass beads with a reflective aluminum coating, and comprises one or more respective lighting elements of the plurality of lighting elements arranged within the perimeter of said each illuminating region.

20. A life jacket comprising:

a buoyant, main body, the main body wearable on a subject's torso and comprising a neck opening, a left arm opening and a right arm opening, the main body further comprising:

a power source; wherein said power source is a waterproof 12 Volt rechargeable battery pack enclosed in silicone coupled to a waterproof power switch with/but not limited to one or more modes of on, flash, strobe, and off, a plurality of lighting element; wherein said lighting element is a waterproof LED light enclosed in a silicone tube, electrically coupled to the power source, and one or more illuminating regions formed on the main body, the one or more illuminating regions configured to allow the passing therethrough of light emitted by the at least one lighting element such that said light is visible from outside the main body; wherein each illuminating region of the one or more illuminating regions is at least partially bordered by a reflective material; wherein said reflective material is micro glass beads with a reflective aluminum coating, and comprises one or more respective lighting elements of the plurality of lighting elements arranged within the perimeter of said each illuminating region; and further wherein the one or more illuminating regions comprise a refractive layer configured to refract the light emitted by the at least one lighting element to substantially uniformly illuminate the one or more illuminating regions.

* * * * *